US005205748A

United States Patent [19]

Petersheim

[11] Patent Number: 5,205,748

[45] Date of Patent: Apr. 27, 1993

[54] PLAY APPARATUS HAVING OBSTACLES

[75] Inventor: Richard J. Petersheim, Charlotte, N.C.

[73] Assignee: Restaurant Technology, Inc., Oak Brook, Ill.

[21] Appl. No.: 845,414

[22] Filed: Mar. 3, 1992

[51] Int. Cl.[5] ..... G09B 19/00; A63B 7/00

[52] U.S. Cl. ..... 434/258; 482/35

[58] Field of Search ..... 434/255, 258, 247; 482/35, 51

[56] References Cited

U.S. PATENT DOCUMENTS

| | | | |
|---|---|---|---|
| 1,917,018 | 7/1933 | Clark | 482/35 |
| 3,485,494 | 12/1969 | Lieberman | 482/35 |
| 3,814,416 | 6/1974 | Munger et al. | 272/56.5 |
| 3,895,796 | 7/1975 | Pestalozzi | 482/35 |
| 3,928,701 | 12/1975 | Roehner | 482/35 X |
| 4,202,233 | 6/1978 | Crane | 434/247 |
| 4,546,965 | 10/1985 | Baxter et al. | 482/35 |
| 4,629,182 | 12/1986 | Rader et al. | 482/35 |
| 4,988,092 | 1/1991 | Trout | 434/255 |

*Primary Examiner*—Gene Mancene
*Assistant Examiner*—L. Thomas
*Attorney, Agent, or Firm*—Jenner & Block

[57] ABSTRACT

A play apparatus for use by children is provided having a base which includes horizontal spaced apart obstacles, legs for supporting the base on a generally flat supporting surface, such as a floor, and a tunnel structure positioned over the base. The tunnel structure has openings which serves as entrances and exits and which define a pathway through the play apparatus. The legs support the obstacles above the floor so that a child must step over the obstacles as he walks through the play apparatus. The tunnel structure is located at a predetermined height over the base. The height chosen requires a child to stoop or bend over while walking through the play apparatus. In one embodiment, the play apparatus has an additional tube attached to and extending through a side wall of the tunnel. The tube provides an additional opening through which a child may crawl. This embodiment has six obstacle members carried by the base. A second embodiment does not contain the additional side tube and has only four obstacle members.

18 Claims, 1 Drawing Sheet

PLAY APPARATUS HAVING OBSTACLES

FIELD OF THE INVENTION

This invention relates to play equipment for children and more particularly to play equipment which provides an obstacle course designed to promote a child's motor coordination skills.

BACKGROUND OF THE INVENTION

While children's play equipment has been around for decades, many parents are unaware of the fundamental role that play equipment has in a child's physical, mental and social development. Generally, many articles of play equipment, such as well-known playground slides and monkey bars, do not offer the fullest opportunity for children to develop. Moreover, some prior art provided limited protection in the event of a fall. In particular, there is a need for play equipment that allows children to practice climbing and balance skills, while safely taking risks. Specifically, there is a need for play equipment that minimizes risk of injury of children playing thereon.

SUMMARY OF THE INVENTION

The present invention provides a play apparatus with obstacles designed to improve a child's motor coordination skills in a safe and controlled environment. The play apparatus includes a base that supports elongated horizontal obstacles and an elongated tunnel structure positioned at a predetermined height. The base may include legs that allow the apparatus to stand on a generally flat supporting surface, such as a floor or playground surface. The tunnel has openings which serve as entrances to and exits from the interior of the play apparatus and which define therebetween a pathway through the play apparatus. The elongated obstacles are positioned so that they extend across the pathway through the play apparatus. In addition, the obstacles are positioned above the supporting surface. A child walking through the interior of the play apparatus must step or crawl over the obstacles, and usually, depending upon the height of the child, while also crouching or stooping under the tunnel structure.

The tunnel structure has a ceiling and side walls which extend downward from the ceiling. The tunnel structure is supported above the floor at a predetermined height which requires children of at least that height to stoop or bend over while walking through the play apparatus. The inventive play apparatus provides a number of advantages. Because such children must bend over or stoop while stepping over the obstacles in the play apparatus, the child's concentration and vision is more likely to be focused on the obstacles. The stooped or bent over posture lowers the child's center of gravity and improves his balance, making the child less likely to stumble or fall. In addition, the side walls block out distractions outside of the play apparatus, thus improving the child's concentration. The side walls also prevent the child from exiting the play structure without stepping over the obstacles. And finally, because the child must crouch under the tunnel structure, the child is inhibited from running or otherwise attempting to cross over the obstacles at a speed which would endanger the child.

The tunnel structure can be constructed from commonly available materials, such as drainage pipes, typically of PVC (polyvinyl chloride) material. The edges of the tunnel structure can be covered with a smooth material to protect the child from any rough spots on the edges.

The play apparatus may include vertical supports which are attached to the tunnel structure and support the tunnel structure above the floor. The obstacles and the vertical supports can be covered with padded materials which protect the child from the hard surfaces of the obstacles and of the vertical supports. Screen netting may be attached to the vertical supports which are adjacent to an opening in the tunnel structure, and extends across the top of the tunnel structure from the vertical support on one side of the opening to the vertical support on the other. The screen netting acts as a barrier which prevents a child from climbing into the space between the tunnel structure and the vertical supports.

DESCRIPTION OF THE PREFERRED EMBODIMENT OF THE INVENTION

Figure 1:
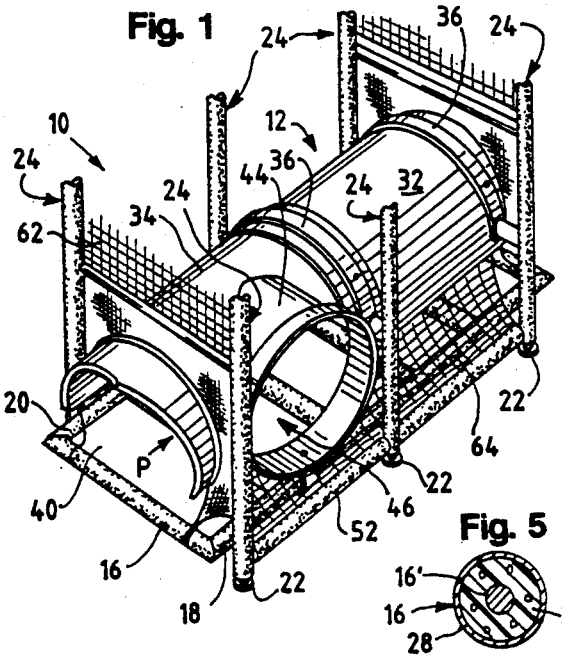
FIG. 1 is a perspective view of a play apparatus according to the present invention.
Figure 4:
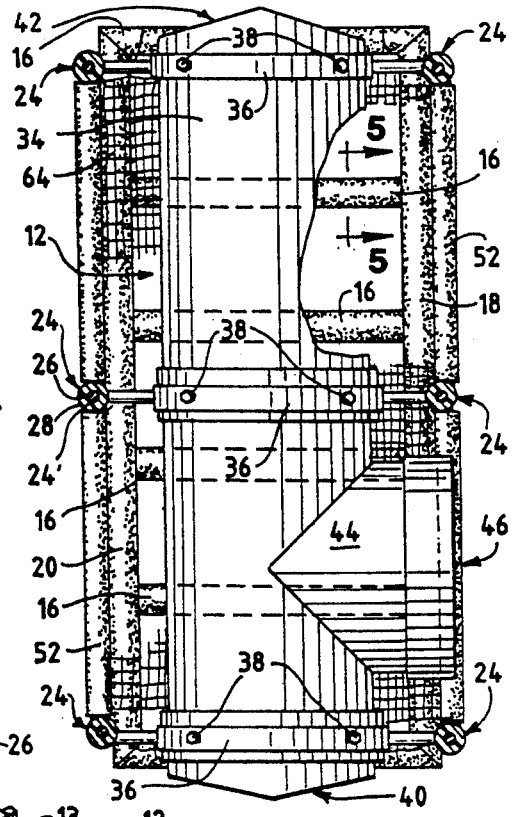
FIG. 4 is a top plan view with a cutaway section illustrating the spaced apart obstacle members over which a child may step or crawl.
Figure 2:
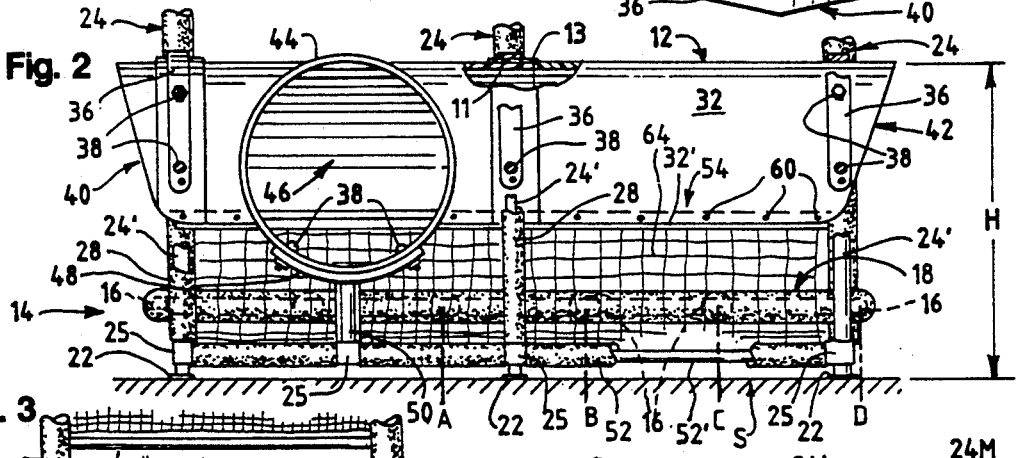
FIG. 2 is a right side elevation view of the apparatus in FIG. 1 illustrating a side aperture entrance and exit.

Referring to the figures generally, and in particular to FIGS. 1, 2, and 4, a play apparatus 10 is provided in accordance with the invention. Apparatus 10 includes an elongated tunnel structure 12 which is supported at a predetermined height H above a supporting surface S by a base 14.

Tunnel structure 12 defines a pathway P through the interior of apparatus 10 through which a child may walk or crawl, and includes sidewalls 32 and 34 and a ceiling 30. Base 14 supports a plurality of spaced apart, elongated padded cylindrical obstacle members 16 which extend transversely across pathway P. As best seen in FIGS. 2 and 4, obstacle members 16 are slightly elevated, horizontal obstructions over which a child steps or crawls.

Figure 3:
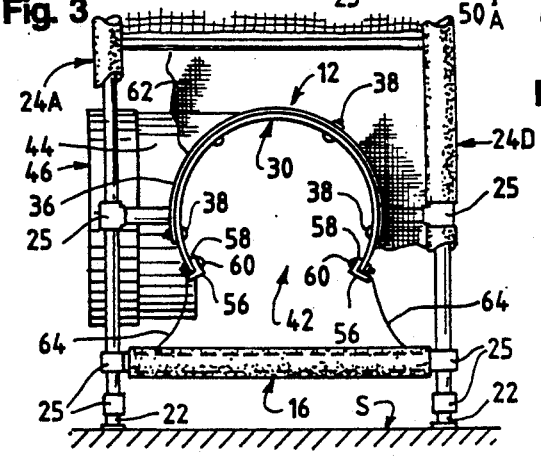
FIG. 3 is a rear elevation view illustrating the opening on the rear of the play apparatus which serves as an entrance to and exit from the play apparatus.

Referring to FIGS. 1, 2 and 3, the structure of base 14 is now described in detail. Base 14 includes two spaced, parallel elongated padded horizontal supports 18 and 20 which extend along the longitudinal extent of pathway P. Each of obstacle members 16 is suitably connected to each of horizontal supports 18 and 20 to span the distance therebetween, as best seen in FIG. 4. Base 14 includes a plurality of leg members 22 which form the foundation of play apparatus 10 and which define the bottom of base 14. Leg members 22 may also be padded and allow play apparatus 10 to stand on a generally flat supporting surface (not shown) such as a floor.

Base 14 has a plurality of padded vertical supports 24 which extend upward from horizontal supports 18 and 20 and which support and stabilize tunnel structure 12. In the illustrated embodiments, leg members 22 and vertical supports 24 are a unitary element (preferably a tube or pipe), and therefore leg members 22 also define the bottom of vertical supports 24. Alternatively, leg members 22 and vertical supports 24 could be of separate structures. Vertical supports 24 can also support tunnel structure 12 at a predetermined height above the flat supporting surface or floor. An elongated stabilizing member 52 extends the length of play apparatus 10 and is attached to vertical supports 24 by sleeve connectors 25. Stabilizing member 52 provides additional support for tunnel structure 12.

It will be noted that obstacle members 16 are also positioned above the bottom of base 14. Although obstacle members 16 can be placed at various heights above the bottom of base 14, the motor coordination skills of a child can be most improved if the height chosen forces the child to raise his legs while stepping over obstacle members 16. However, the height should not be so great that the child loses his balance while stepping over obstacle members 16. A height of about twelve inches challenges a child and promotes his motor coordination skills without also creating an overly difficult obstacle.

FIG. 2 illustrates in phantom how obstacle members 16 are arranged in play apparatus 10 above the bottom of base 14. The illustrated embodiment has six obstacle members, although the number of obstacle members can be greater or less than six. Obstacle members 16 (drawn in phantom lines in FIG. 2) are positioned so that the distance between adjacent obstacle members 16 is the same from one end of the obstacle path to the other. For example, the horizontal distance A-B equals the horizontal distance C-D. In one embodiment, a center to center spacing of about eighteen inches between adjacent obstacle members 16 is provided. A more challenging obstacle path could be constructed by varying the distance between the obstacle members. The important factor in determining the horizontal distance separating adjacent obstacle members 16 is the fact that a child must be able to stand in the space between adjacent obstacle members 16 in order to step over one of obstacle members 16. For this reason there is a practical lower limit to the space separating adjacent obstacle members 16, which is determined by the size and age of the children for which the apparatus is intended.

Preferably, the components of base 14 (including vertical supports 24, horizontal supports 18 and 20, obstacle members 16, and leg members 22 collectively, the "Components") are made of standard metal pipe or tubing, such as two-inch pipe, for example, and are connected together using conventional clamps or sleeve connectors 25. Such clamps are commercially available from suppliers such as Kee Industries.

Figure 5:
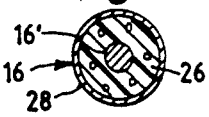
FIG. 5 is a cross sectional view along line 5—5 in FIG. 4.

As best seen in FIG. 5, which is a cross-sectional view of one of obstacle members 16 along line 5—5 in FIG. 4, obstacle member 16 is composed of interior pipe 16' padded by a jacket 26 of foam padding (preferably of polyethylene) and an outer sleeve 28. As is conventional, each jacket 26 may have a longitudinal slit (not shown) which enables jacket 26 to be placed over one of the Components of base 14. Each of jackets 26 is then covered by sleeve 28, as is conventional. Sleeve 28 can be constructed of any suitable material such as vinyl, for example, and can be secured over jacket 26 in any suitable way, such as by stitching, adhesive or otherwise, for example. Preferably, each of the components of base 14 is similarly padded. As shown in FIG. 4, vertical support 24 includes an interior pipe 24', vinyl sleeve 28 and jacket 26.

In FIG. 2, vertical supports 24, horizontal support 18, and obstacle members 16 are illustrated with padding. Stabilizing member 52 is also illustrated with padding, part of which has been cut away to show the interior pipe 52'.

Referring to FIGS. 2, 3 and 4, the structure of tunnel structure 12 is now discussed in greater detail. Tunnel structure 12 is supported by base 14 and over obstacle members 16 and has a ceiling 30 and side walls 32 and 34. Side walls 32 and 34 extend downward from ceiling 30. Tunnel structure 12 can be constructed from a variety of materials. Commonly available drainage pipes, for example, such as PVC pipe, can be used to construct tunnel structure 12 and when properly cut provide an arcuate or circular arc cross section. Tunnel structure 12 can be constructed from more than one piece of pipe, with the pieces joined together to provide a longer tunnel structure 12. In FIG. 2, part of tunnel structure 12 has been cut away to show the juncture between the pieces of pipe used to construct play apparatus 10. The edge 11 of one piece of pipe is placed within the edge 13 of a second piece of pipe to provide a longer tunnel structure 12.

Tunnel structure 12 is supported by base 14 at predetermined height H above the flat supporting surface or floor. Height H of tunnel structure 12 is measured from the bottom of leg members 22 to tunnel ceiling 30. Height H is one which requires a child to stoop or bend over while negotiating the obstacle path within play apparatus 10. The height can vary with the age group of children intended to use play apparatus 10 and should be less than the average height of the generally intended group of children. In a particularly preferred embodiment this height is about 44 inches.

Tunnel structure 12 includes circular arc support members 36 which are used to position tunnel structure 12 over base 14. Circular arc support members 36 can consist of commercially available half saddle clamps. In FIG. 3, the inner surfaces of circular arc support members 36 are flush with the outer surface of tunnel structure 12 because the outer radius of curvature of the cross section of tunnel structure 12 equals the inner radius of curvature of circular arc support members 36. Circular arc support members 36 are attached to tunnel structure 12 and to vertical supports 24. Circular arc support members 36 can be attached to tunnel structure 12 by any conventional means, such as the bolts 38 shown in FIGS. 2 and 3.

Tunnel structure 12 has at least one opening 40 that serves as an entrance to and exit from the interior of play apparatus 10. As illustrated in FIGS. 2 and 4, tunnel structure 12 has a second rear opening 42 located at the end opposite opening 40. Front opening 40 and rear opening 42 are formed by the open bottom of tunnel structure 12. A child enters play apparatus 10 through an opening, such as front opening 40 or rear opening 42, and then steps or crawls over obstacle members 16 within play apparatus 10. The pathway the child uses to enter and exit play apparatus 10 can vary with the number and arrangement of openings in tunnel structure 12.

Tunnel structure 12 of play apparatus 10 has a tube port 44 attached to and extending through side wall 32 of tunnel structure 12 so that a child may crawl through tube port 44 to enter or exit play apparatus 10. Tube port 44 is constructed of a short tube section open at both ends. Tube port 44 thus has a tube opening 46 which defines additional pathways through play apparatus 10. Tube opening 46 is best illustrated in FIG. 1.

A circular support member 48, which is a particular type of a circular arc support, is used to support tube port 44, as illustrated in FIG. 2. Circular support member 48 is placed around tube port portion 44 and is attached to tube port 44 with bolts 38. A tubular stem 50 extends downward from circular support member 48 and is attached to elongated stabilizing member 52 positioned below tube port 44. Stabilizing member 52 provides support for tube port 44.

An angle member 54 is used to cover any rough or sharp surfaces which may be present along bottom longitudinal edges 32' of side walls 32 and 34, and to add strength and rigidity to tunnel structure 12. Angle member 54 consists of two elongated generally rectangular sides 56 and 58 which extend from the middle of angle member 54 at an angle to each other. The angle member is placed over the bottom edge of a side wall so that one rectangular side is located on the external lower surface of the side wall and the second rectangular side is located on the internal lower surface of the same side wall. For example, in FIG. 2, angle member 54 is positioned on the bottom edge (not shown) of side wall 32. Rectangular side 56 is located on the external lower surface of side wall 32. As illustrated in FIG. 3, rectangular side 58 abuts the internal lower surface of side wall 32. Angle member 54 can be constructed from a variety of materials. A material with a smooth surface, such as polyvinyl chloride, is particularly preferred. Angle member 54 is attached to tunnel side walls 32 and 34 using conventional means such as bolts 60.

Referring to FIGS. 2 and 3, it will be observed that play apparatus 10 includes passive safety features. A screen net 62 is suitably attached to tunnel structure 12 and to vertical supports 24A and 24D adjacent rear opening 42 and extends across the top of tunnel structure 12 to create a barrier between tunnel structure 12 and vertical supports 24A and 24D. The barrier keeps children from climbing or crawling into the space between the tunnel structure and the adjacent vertical posts. Materials other than screen netting can be used as desired to create the barrier between the tunnel structure and the adjacent posts. A similar barrier is located adjacent front opening 40 of play apparatus 10. Additional screen netting 64 extends from the bottom edges of tunnel structure 12 to horizontal supports 18 and 20.

In connecting nets 62 and 64 to tunnel structure 12, vertical supports 24, and horizontal supports 18 and 20, a variety of well known techniques may be used. For example, the edges of the nets may be provided with a grommet-bearing flange. A line or cord can be laced through the grommets and around vertical supports 24 or around horizontal supports 18 and 20. It will be noted that the longitudinal slits of jackets 26 can be used to accommodate the line or cord connecting nets 62 or 64 with tunnel structure 12, vertical supports 24 or horizontal supports 18 and 20. Another technique for fastening nets 62 and 64 to tunnel structure 12, vertical supports 24, and horizontal supports 18 and 20, is disclosed in co-pending U.S. Pat. application Ser. No. 07/945,130 filed Mar. 3, 1992 entitled "Play Apparatus Having Inclined Surfaces for Climbing and Sliding", filed concurrently herewith the disclosure of which is hereby incorporated by reference.

Figure 6:
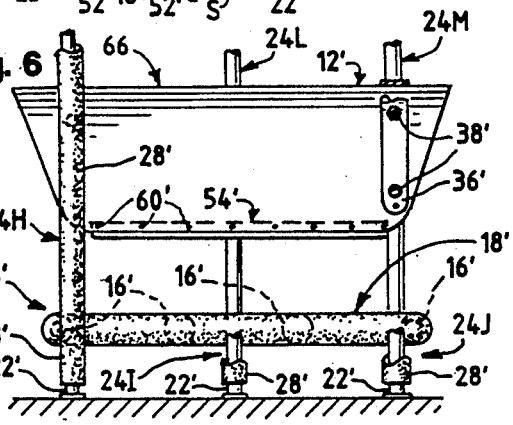
FIG. 6 is a side elevation view of a second embodiment of the present invention.

Referring to FIG. 6, a play apparatus 66 in accordance with a second embodiment of the invention is illustrated. Vertical supports 24H, 24I and 24J at the side of play apparatus 66, as well as jackets 26 (not shown) and vinyl sleeves 28' surrounding them, have been cut away for greater clarity. Vertical supports 24L and 24M located at the far side of play apparatus 66 are also encased within jackets (not shown) and vinyl sleeves (not shown), similar to jackets 26 and vinyl sleeves 28 described with respect to FIG. 5.

Play apparatus 66 includes tunnel structure 12', base 14', leg members 22', circular arc support members 36', arc support bolts 38', angle member 54', angle member bolts 60', horizontal support 18' and a spaced apart parallel horizontal support (not shown) and obstacle members 16' shown in phantom lines. Tunnel structure 12' is similar to tunnel structure 12 previously described but is shorter in length and does not have a side tube portion. Play apparatus 66 has four evenly spaced obstacle members 16', shown in phantom lines in FIG. 6. Tunnel structure 12' is shorter as a consequence of having only four obstacle members attached to base 14'. Arc support, members 36', angle member 54', and horizontal support member 18' are similar to arc support members 36, angle member 54, and horizontal support 18 previously described with respect to play apparatus 10, except that these elements are sized appropriately for play apparatus 66. These elements are assembled in a similar manner as described previously with respect to play apparatus 10. Suitable netting (not shown) may also be used with play apparatus 66.

The advantages of the present invention are now explained by illustration of the use of play apparatus 10. A child may enter play apparatus 10 through any of the openings in tunnel structure 12, such as front opening 40 or tube port opening 46, and then steps or crawls over obstacle members 16 within play apparatus 10. The pathway the child uses to enter and exit play apparatus 10 can vary with the number and arrangement of openings in tunnel structure 12. Each opening can serve as both an entrance and an exit. If tunnel structure 12 has only one such opening, the child would enter and exit play apparatus 10 through the same opening. The pathway through tunnel structure 12 would then take the child over the same obstacle members on entrance to or exit from tunnel structure 12. Tunnel structure 12 can also have more than one opening whereby a child could enter play apparatus 10 through one opening and exit play apparatus 10 through a different opening, in which case the child would not necessarily walk or crawl over the same obstacle members on entrance to and exit from tunnel structure 12.

The main pathway extends from front opening 40 to rear opening 42. Obstacle members 16 are attached to horizontal supports 18 and 20 and extend across the main path. Obstacle members 16 are positioned above the floor or flat supporting surface and thus require the child to raise his legs while stepping over obstacle members 16. In addition, the height at which tunnel structure 12 is positioned over base 14 and obstacle members 16 forces the child to stoop or bend over while walking over obstacle members 16.

Tunnel structure 12 is designed to help a child improve his motor coordination skills while stepping or crawling over obstacle members 16. When a child is presented with an open, unenclosed pathway containing obstacles over which the child should walk or crawl, the child often fails, for many reasons, to successfully negotiate the obstacle path. The child may be distracted by something outside of the obstacle path and then trip or fall when he stops looking at the obstacle path and looks at the distraction. The child may simply decide to leave the obstacle path along the side without going from one end of the obstacle path to the other end. The child may also try to negotiate the obstacle path too quickly, lose his balance, and then trip or fall over the obstacles.

Tunnel structure 12 is designed to overcome many of the problems associated with open obstacle paths. Side walls 32 and 34 serve at least two functions. First, side walls 32 and 34 block the view of a child who is within play apparatus 10. Because the child cannot see things which are outside of play apparatus 10, side walls 32 and 34 help the child to concentrate on the obstacle path and keep him from becoming distracted by things outside of the obstacle path. Side walls 32 and 34 also create barriers along the sides of the obstacle path. A child within play apparatus 10 cannot easily avoid negotiating the obstacle path by simply leaving the obstacle path along the side. Screen netting 64 also serves to keep the child within play apparatus 10.

As illustrated in FIGS. 1–6, tunnel structure 12 has an arcuate cross section. An arcuate cross section, especially a circular arc cross section, promotes the objectives of the present invention by preventing a child from exiting play apparatus 10 at a side without stepping over obstacle members 16, and by shielding a child from distractions outside of play apparatus 10. Other types of tunnel structures could promote the objectives of the present invention, which is not limited to tunnel structures with arcuate or circular arc cross sections. For example, a tunnel structure with straight side walls extending at a single angle from the ceiling juncture, such as an "A" frame type structure (not shown) with a triangular cross section, would be consistent with the objectives of shielding a child from external distractions and preventing the child's exit from the play apparatus without stepping over obstacle members 16. Similarly, a tunnel structure having a flat ceiling and sides extending downward from the ceiling, such as an inverted "U" type structure (not shown), would promote the same objectives. The most significant objectives are forcing or encouraging a child to stoop or bend over while negotiating the pathway and preventing the child from exiting without negotiating the obstacle path. Any structure which achieves these objectives would be in accordance with the present invention.

The height at which tunnel structure 12 is positioned over obstacle members 16 also promotes the objectives of the present invention. A height which forces a child to stoop or bend over while negotiating the obstacle path serves at least three functions. First, requiring the child to stoop or bend over forces the child to look at the obstacle path while he is stepping or crawling over obstacle members 16. The height thus helps a child to concentrate on the obstacle path. Second, a bent over or stooped posture also lowers a child's center of gravity and thus improves the child's balance while stepping or crawling over obstacle members 16. Third, requiring a child to stoop or bend over while negotiating the obstacle path helps to slow the child down and thus makes it less likely that the child will trip or fall. The present invention thus facilitates the development of a child's motor coordination skills while presenting a safe and controlled environment through the use of safety features such as jacket 26 and vinyl sleeve 28 or nets 62 and 64.

While the invention has been described with respect to certain preferred embodiments, it is to be understood that the invention is capable of numerous changes, modifications and rearrangements without departing from the scope or spirit of the invention as defined in the claims.

What is claimed is:

1. A play apparatus for children comprising:

an elongated tunnel structure defining a tunnel ceiling, side walls and at least one opening defining an entrance and an exit, the tunnel structure further defining a pathway through the interior of the apparatus through which a child is able to walk;

a base having a plurality of leg members defining a base bottom and the base allowing the apparatus to stand on a generally flat supporting surface, said base also supporting the elongated tunnel structure a predetermined distance above the flat supporting surface;

a plurality of spaced apart elongated obstacle members supported by the base, the elongated obstacle members extending transverse to the pathway through the interior of the apparatus and located above the bottom of the base.

2. The apparatus of claim 1 wherein each elongated obstacle member is evenly horizontally spaced from adjacent elongated obstacle members.

3. The apparatus of claim 1, wherein the center to center spacing of adjacent obstacle members is about eighteen inches.

4. The apparatus of claim 1 wherein the number of obstacle members is six.

5. The apparatus of claim 1 wherein the top of each elongated obstacle member is about twelve inches from the bottom of the base.

6. The apparatus of claim 1 wherein the elongated obstacle members are cylindrical and have a longitudinal cylindrical axis oriented transverse to the pathway.

7. The apparatus of claim 1 wherein the height of the tunnel ceiling is about forty-four inches from the bottom of the base.

8. The apparatus of claim 1 wherein the tunnel structure has an open bottom and an arcuate cross section.

9. The apparatus of claim 1 wherein the tunnel structure further comprises a tube portion attached to and extending through one of the side walls of the tunnel structure and providing an aperture through which a child may enter and exit the apparatus.

10. The apparatus of claim 1 wherein the tunnel structure has a circular arc cross section.

11. The apparatus of claim 10 wherein the tunnel structure further comprises a plurality of circular arc support members having a circular arc cross section attached to the outside top surface of the tunnel structure.

12. The apparatus of claim 11 wherein the outer radius of curvature of the tunnel cross section equals the inner radius of curvature of the circular arc support members.

13. The apparatus of claim 1 wherein the tunnel structure has bottom longitudinal edges and further comprises an elongated PVC angle member covering the bottom longitudinal edges of the tunnel structure.

14. The apparatus of claim 1 wherein the base further comprises at least one cross member extending longitudinally to the pathway and having the spaced apart obstacle members connected thereto.

15. The apparatus of claim 1 wherein the base further comprises a plurality of spaced apart vertical support members having upper portions and bottom ends and a plurality of spaced apart horizontal support members, each vertical support member attached to one of the horizontal support members near the bottom end of the vertical support member and being attached to the tunnel structure between the upper portion of the vertical support member and the attachment location of the horizontal support members and the vertical support members.

16. The apparatus of claim 15 wherein the horizontal support members are attached to the vertical support members above the bottom ends of the vertical support members at a location less than or equal to twelve inches above the bottom ends of the vertical support members.

17. The apparatus of claim 15 wherein the tunnel structure is located between the vertical support members.

18. The apparatus of claim 17 wherein the tunnel structure further comprises a barrier at each end of the tunnel structure extending between each side of the tunnel structure and a vertical support member adjacent each tunnel side, to prevent access between the tunnel structure and vertical supports.

* * * * *